US010435867B2

(12) United States Patent
Fukuda

(10) Patent No.: US 10,435,867 B2
(45) Date of Patent: Oct. 8, 2019

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 99 days.

(21) Appl. No.: 15/854,168

(22) Filed: Dec. 26, 2017

(65) Prior Publication Data

US 2018/0179736 A1 Jun. 28, 2018

(30) Foreign Application Priority Data

Dec. 28, 2016 (JP) ..... 2016-255461
Nov. 27, 2017 (JP) ..... 2017-227076

(51) Int. Cl.
*E02F 9/22* (2006.01)
*F15B 13/042* (2006.01)
(Continued)

(52) U.S. Cl.
CPC ..... *E02F 9/2267* (2013.01); *E02F 3/3414* (2013.01); *E02F 9/226* (2013.01); *E02F 9/2225* (2013.01); *E02F 9/2253* (2013.01); *E02F 9/2289* (2013.01); *E02F 9/2292* (2013.01); *F15B 13/0426* (2013.01); *E02F 9/0875* (2013.01); *E02F 9/166* (2013.01); *F15B 13/044* (2013.01); *F15B 21/042* (2013.01);
(Continued)

(58) Field of Classification Search
CPC .. F15B 2211/31541; F15B 2211/31564; F15B 2211/715; E02F 9/2267
See application file for complete search history.

(56) References Cited

U.S. PATENT DOCUMENTS 4,030,623 A * 6/1977 Bridwell ..... E02F 9/2239 414/694
4,464,898 A * 8/1984 Aoyagi ..... F16H 61/4157 60/436
(Continued)

FOREIGN PATENT DOCUMENTS

JP 2013117253 A * 6/2013
JP 5809544 9/2015

*Primary Examiner* — Thomas E Lazo
(74) *Attorney, Agent, or Firm* — Greenblum & Bernstein, P.L.C.

(57) ABSTRACT

A hydraulic system for a working machine includes a first hydraulic apparatus to be activated by the operation fluid, a second hydraulic apparatus being configured to be activated by the operation fluid, a first operation valve to control the operation fluid to be supplied to the first hydraulic apparatus, a second operation valve to control the operation fluid to be supplied to the second hydraulic apparatus, a first fluid tube connecting the first operation valve to the first hydraulic apparatus, a second fluid tube connecting the first operation valve to the second hydraulic apparatus, a third fluid tube connecting the first fluid tube to the second fluid tube, and an outputting fluid tube connected to any one of the first operation valve and the second operation valve and configured to output the operation fluid supplied from any one of the first fluid tube and the second fluid tube.

11 Claims, 10 Drawing Sheets

(51) Int. Cl.

| | |
|---|---|
| ***E02F 3/34*** | (2006.01) |
| *F15B 13/044* | (2006.01) |
| *E02F 9/08* | (2006.01) |
| *E02F 9/16* | (2006.01) |
| *F15B 21/042* | (2019.01) |

(52) U.S. Cl.

CPC ..... *F15B 2013/0428* (2013.01); *F15B 2211/20561* (2013.01); *F15B 2211/611* (2013.01); *F15B 2211/62* (2013.01); *F15B 2211/7058* (2013.01); *F15B 2211/715* (2013.01); *F15B 2211/7128* (2013.01); *F15B 2215/30* (2013.01)

(56) References Cited

U.S. PATENT DOCUMENTS

| | | | | |
|---|---|---|---|---|
| 4,495,767 | A * | 1/1985 | Akiyama | B60K 17/10 192/221 |
| 4,838,756 | A * | 6/1989 | Johnson | E02F 9/2232 414/694 |
| 2016/0146230 | A1* | 5/2016 | Jung | E02F 9/128 60/428 |
| 2016/0304071 | A1* | 10/2016 | Fukuda | A01B 1/00 |
| 2017/0107695 | A1* | 4/2017 | Fukuda | F16H 61/4035 |

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. 2016-255461, filed Dec. 28, 2016 and to Japanese Patent Application No. 2017-227076, filed Nov. 27, 2017. The contents of these applications are incorporated herein by reference in their entirety.

BACKGROUND OF THE INVENTION

Field of the Invention

The present invention relates to a hydraulic system for a working machine such as a skid steer loader, a compact track loader, and the like.

Discussion of the Background

Japanese Patent Publication No. 5809544 previously discloses a technique for warming up a working machine.

The working machine disclosed in Japanese Patent Publication No. 5809544 includes a pilot pressure control valve and a valve body. The pilot pressure control valve is configured to control a pressure of a pilot fluid outputted from a pump and sent to a supplying target. The valve body incorporates the pilot pressure control valve. In the working machine disclosed in Japanese Patent Publication No. 5809544, the valve body is provided with a heat-up fluid tube into which the pilot fluid outputted from the pump is supplied, the pilot fluid supplied into the heat-up fluid tube is supplied to an operation fluid tank through a relief valve or a throttle, and thereby the valve body is heated up.

SUMMARY OF THE INVENTION

A hydraulic system for a working machine of the present invention, includes a hydraulic pump to output an operation fluid, a first hydraulic apparatus to be activated by the operation fluid, a second hydraulic apparatus other than the first hydraulic apparatus, the second hydraulic apparatus being configured to be activated by the operation fluid, a first operation valve to control the operation fluid to be supplied to the first hydraulic apparatus, a second operation valve to control the operation fluid to be supplied to the second hydraulic apparatus, a first fluid tube connecting the first operation valve to the first hydraulic apparatus, a second fluid tube connecting the first operation valve to the second hydraulic apparatus, a third fluid tube connecting the first fluid tube to the second fluid tube, and an outputting fluid tube connected to any one of the first operation valve and the second operation valve and configured to output the operation fluid supplied from any one of the first fluid tube and the second fluid tube.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
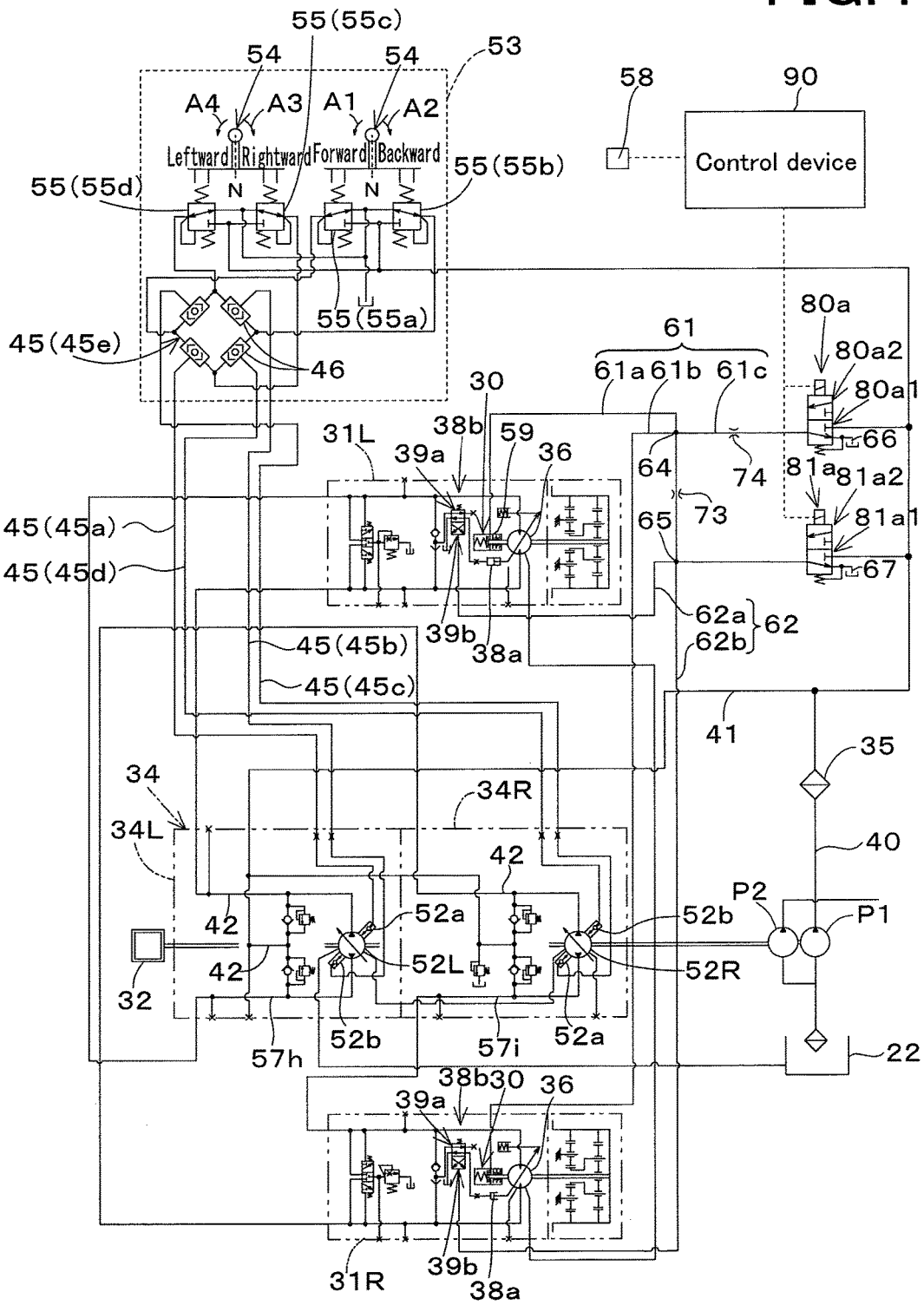
FIG. 1 is a view illustrating a traveling hydraulic system (a hydraulic circuit) for a working machine according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Referring to drawings, the embodiments of the present invention, a hydraulic system for a working machine 1 and the working machine 1 having the hydraulic system, will be described below.

First Embodiment

A working machine will be explained below.

Figure 6:
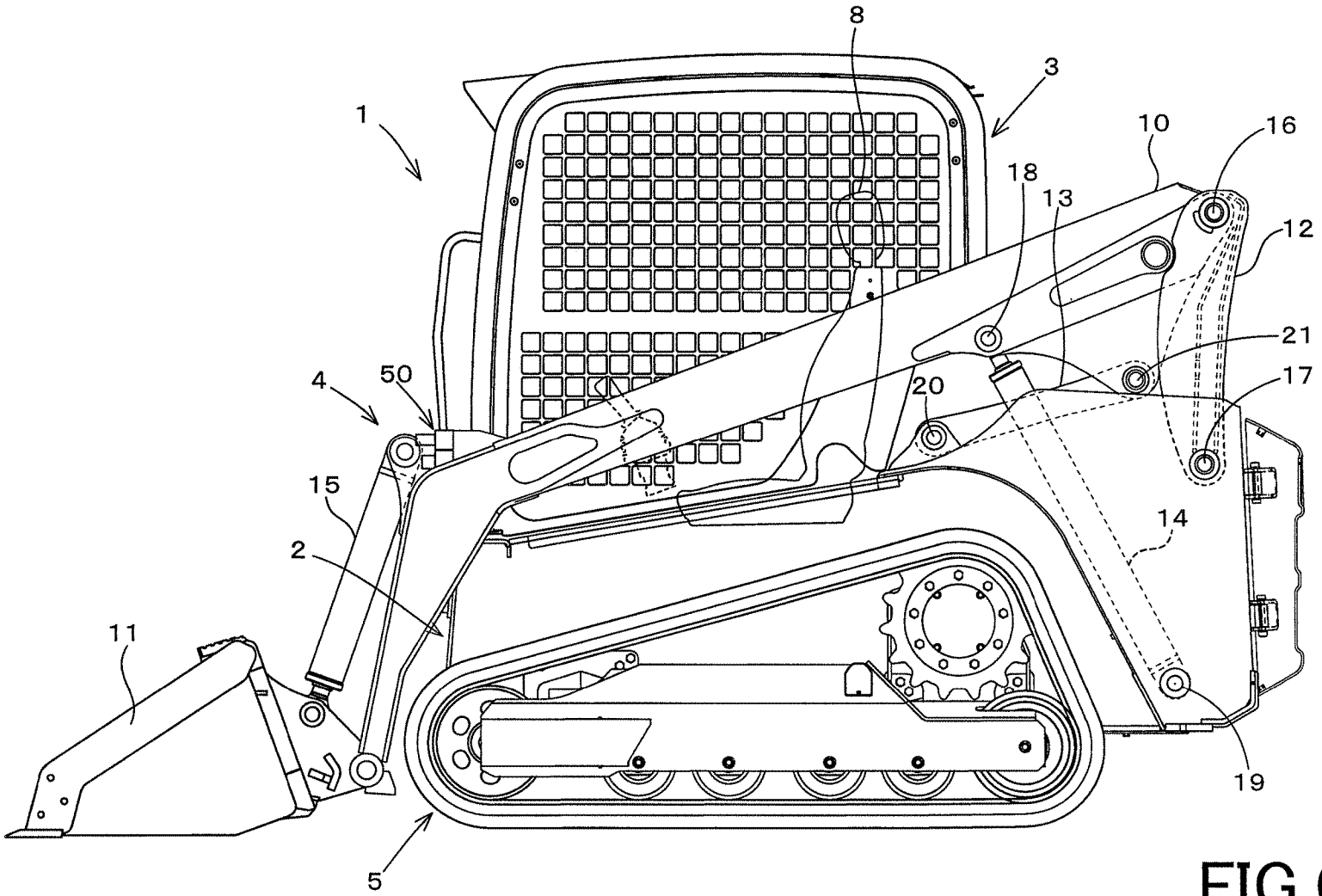
FIG. 6 is a side view illustrating a track loader as one example of the working machine according to the embodiments.

FIG. 6 shows a side view of the working machine 1 according to the embodiments of the present invention. FIG. 6 shows a compact track loader as an example of the working machine 1. However, the working machine 1 according to the embodiments is not limited to the compact track loader. The working machine 1 may be other types of the working machine such as a Skid Steer Loader (SSL). In addition, the working machine 1 may be other types of the working machine other than a loader working machine.

Figure 7:
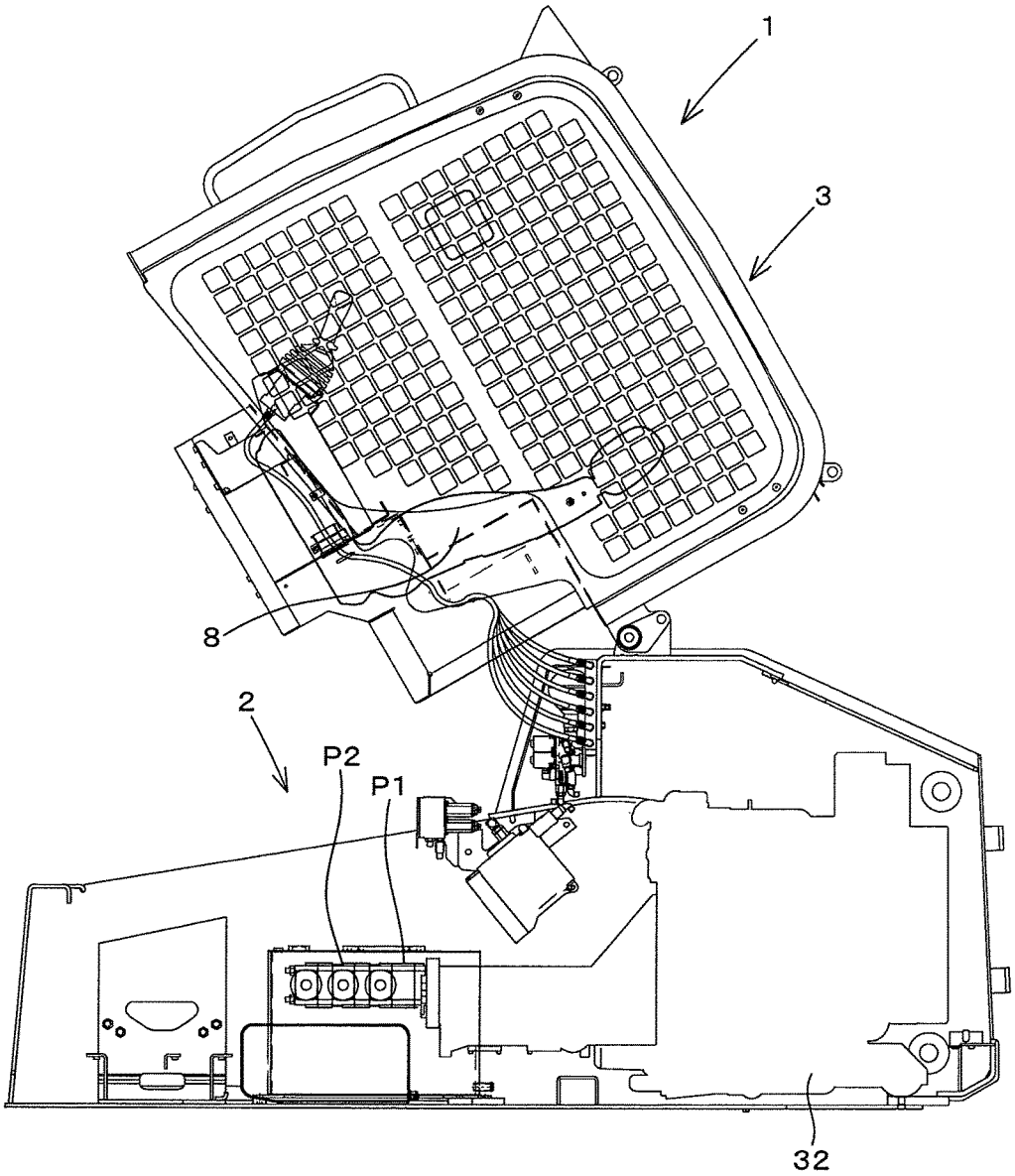
FIG. 7 is a side view illustrating a part of the track loader lifting up a cabin according to the embodiments.

As shown in FIG. 6 and FIG. 7, the working machine 1 according to embodiments of the present invention includes a machine body (a vehicle body) 2, a cabin 3, an operation device 4, and a traveling device 5.

Hereinafter, in explanations of all the embodiments of the present invention, a forward direction (a left side in FIG. 6) corresponds to a front side of an operator seated on an operator seat 8 of the working machine 1, a backward direction (a right side in FIG. 6) corresponds to a back side of the operator, a leftward direction (a front surface side of the sheet of FIG. 6) corresponds to a left side of the operator, and a rightward direction (a back surface side of the sheet of FIG. 6) corresponds to a right side of the operator. Additionally in the explanations, a machine width direction corresponds to a horizontal direction (a lateral direction) perpendicular to the front to rear direction. A machine outward direction corresponds to a direction from a center portion of the machine body 2 to the right portion of the machine body 2 and to the left portion of the machine body 2.

In other words, the machine outward direction corresponds to the machine width direction, especially corresponds to a direction separating from the machine body 2. In the explanation, a machine inward direction corresponds to a direction opposite to the machine outward direction. In other words, the machine inward direction corresponds to the machine width direction, especially corresponds to a direction approaching the machine body 2 from the outside of the machine body 2.

The cabin 3 is mounted on the machine body 2. The operator seat 8 is disposed inside the cabin 3. The operation device 4 is constituted of a device configured to perform the working, the operation device 4 being attached to the machine body 2. The traveling device 5 is disposed on the outside of the machine body 2. A prime mover (an engine or an electric motor) 32 is mounted on a rear portion of the machine body 2 internally. The prime mover 7 is constituted of a diesel engine (that is, an engine). Meanwhile, the prime mover 7 is not limited to the engine, and may be constituted of an electric motor or the like.

The operation device 4 includes booms 10, a working tool 11, lift links 12, control links 13, boom cylinders 14, and bucket cylinders 15.

The operation device 4 includes two booms 10; one of the booms 10 is provided on a right side of the cabin 3 (referred to as the right boom 10) and is capable of freely swinging upward and downward, and the other one of the booms 10 is provided on a left side of the cabin 3 (referred to as the left boom 10) and is capable of freely swinging upward and downward. The working tool 11 is a bucket (hereinafter referred to as a bucket 11), for example. The bucket 11 is disposed on tip portions (front end portions) of the booms 10 and is capable of being freely swung upward and downward.

The lift link 12 and the control link 13 support a base portion (a rear portion) of the boom 10 such that the boom 10 is capable of being freely swung upward and downward. The boom cylinder 14 is capable of being stretched and shortened to move the boom 10 upward and downward. The bucket cylinder 15 is capable of being stretched and shortened to swing the bucket 11.

The operation device 4 includes two lift links 12, two control links 13, and two boom cylinders 14. One of the lift links 12 (the right lift link 12), one of the control links 13 (the right control link 13), and one of the boom cylinders 14 (the right boom cylinder 14) are disposed on a right side of the machine body 2, corresponding to the right boom 10. And, the other one of the lift links 12 (the left lift link 12), the other one of the control links 13 (the left control link 13), and the other one of the boom cylinders 14 (the left boom cylinder 14) are disposed on a left side of the machine body 2, corresponding to the left boom 10.

The lift link 12 is vertically disposed on a rear portion of the base portion of the boom 10. The lift link 12 is pivotally supported at an upper portion (one end side) of the lift link 12 by an upper portion of a base portion of the boom 10.

In addition, the lift link 12 is pivotally supported at a lower portion (the other end side) of the lift link 12 by a pivotal shaft (a second pivotal shaft) 17 to be close to a rear portion of the machine body 2, and is capable of freely turning about a lateral axis of the pivotal shaft 17. The second pivotal shaft 17 is arranged below the first pivotal shaft 16.

The boom cylinder 14 is pivotally supported at an upper portion of the boom cylinder 14 by a pivotal shaft (a third pivotal shaft) 18, and is capable of freely turning about a lateral axis of the third pivotal shaft 18. The third pivotal shaft 18 is arranged on each of base portions of the booms 10, specifically on a front portion of the base portion. The boom cylinder 14 is pivotally supported at a lower portion of the boom cylinder 14 by a pivotal shaft (a fourth pivotal shaft) 19, and is capable of freely turning about a lateral axis of the pivotal shaft 19. The fourth pivotal shaft 19 is arranged below the third pivotal shaft 18 to be close to a lower portion of the rear portion of the machine body 2.

The control link 13 is arranged forward from the lift link 12. One end of the control link 13 is pivotally supported by a pivotal shaft (a fifth pivotal shaft) 20, and is capable of freely turning about a lateral axis of the pivotal shaft 20. The fifth pivotal shaft 20 is disposed on the machine body 2, specifically on a position in front of and corresponding to the lift link 12.

The other end of the control link 13 is pivotally supported by a pivotal shaft (a sixth pivotal shaft) 21, and is capable of freely turning about a lateral axis of the pivotal shaft 21. The fifth pivotal shaft 21 is disposed on the boom 10, specifically in front of the second pivotal shaft 17 and above the second pivotal shaft 17.

The boom cylinder 14 is stretched and shortened, and thereby each of the booms 10 is swung upward and downward about the first pivotal shaft 16 with the base portion of each of the booms 10 supported by the lift link 12 and the control link 13. In this manner, the tip end portion of each of the booms 10 is moved upward and downward. The control link 13 is swung upward and downward about the fifth pivotal shaft 20 in accordance with the upward swing and downward swing of the booms 10. The lift link 12 is swung forward and backward about the second pivotal shaft 17 in accordance with the upward swing and downward swing of the control link 13.

Not only the bucket 11, other working tools can be attached to the tip end (the front portion) of the boom 10. The following attachments (spare attachments) are exemplified as the other working tools; for example, a hydraulic crusher, a hydraulic breaker, an angle broom, an earth auger, a pallet fork, a sweeper, a mower, a snow blower, and the like.

A connecting member 50 is disposed on the front portion of the boom 10 arranged to the left.

A hydraulic apparatus is installed on the auxiliary attachment. The connecting member 50 is a device configured to connect the hydraulic apparatus to a first tube member such as a pipe disposed on the boom 10. In particular, the first tube member is configured to be connected to one of the connecting member 50. A second tube member is connected to the hydraulic apparatus of the auxiliary attachment. The second tube member is configured to be connected to the other end of the connecting member 50. In this manner, the operation fluid flowing in the first tube member is supplied to the hydraulic apparatus through the second tube member.

The bucket 15 is arranged close to each of the front portions of the booms 10. The bucket cylinder 15 is stretched and shortened, and thereby the bucket 11 is swung.

In the embodiment, each of the travel device 5 arranged to the left and the travel device 5 arranged to the right employs a crawler travel device (including a semi-crawler travel device). However, each of the travel device 5A and the travel device 5B may employ a wheeled travel device having a front wheel and a rear wheel.

Next, the hydraulic system for the working machine 1 according to a first embodiment of the present invention will be described. The hydraulic system for the working machine 1 has a traveling hydraulic system and an operating hydraulic system.

As shown in FIG. 1, the traveling hydraulic system is a system configured to drive the traveling device 5, and includes a prime mover 32, a first hydraulic pump (a hydraulic pump) P1, a first traveling motor mechanism 31L, a second traveling motor mechanism 31R, and a traveling driving circuit 34.

The prime mover 32 is constituted of an electric motor, an engine, or the like. In this embodiment, the prime mover 32 is constituted of an engine. The first hydraulic pump P1 is constituted of a pump configured to be driven by the power of the prime mover 32, and is constituted of a constant displacement gear pump. The first hydraulic pump P1 is configured to output the operation fluid stored in the tank (operation fluid tank) 22.

An outputting fluid tube 40 through which the operation fluid flows is disposed on the outputting side of the first hydraulic pump P1. In the embodiments of the present invention, the fluid tube serves as an oil passage (also referred to as an operation fluid tube). A filter 35 is disposed on the intermediate portion of the outputting fluid tube 40. The outputting fluid tube 40 is branched into a plurality of sections on the outputting side of the operation fluid. A first charging fluid tube 41 is connected to the outputting side of the outputting fluid tube 40.

The first charging fluid tube 41 reaches the traveling drive mechanism 34. Of the hydraulic fluid outputted from the first hydraulic pump P1, the hydraulic fluid used for control may be referred to as pilot fluid, and the pressure of pilot fluid may be referred to as a pilot pressure.

The traveling drive mechanism 34 is a mechanism configured to drive the first traveling motor mechanism 31L and the second traveling motor mechanism 31R, and includes a driving circuit (a left driving circuit) 34L configured to drive the first traveling motor mechanism 31L and a driving circuit (a right driving circuit) 34R configured to drive the second traveling motor mechanism 31R.

The driving circuits 34L and 34R have HST pumps (the traveling pumps) 52L and 52R, the speed-changing fluid tubes (the transmission fluid tubes) 57*h* and 57*i*, and a second charging fluid tube 42, respectively. The speed-changing fluid tubes (the transmission fluid tubes) 57*h* and 57*i* are fluid tubes (fluid tubes) connecting the HST pumps 52L and 52R to the HST motor 36.

The second charging fluid tube 42 is a fluid tube (a fluid tube) connected to the speed-changing fluid tubes 57*h* and 57*i* and configured to charging the operation fluid outputted from the first hydraulic pump P1 to the speed-changing fluid tubes 57*h* and 57*i*. Each of the HST pumps 52L and 52R is constituted of a variable displacement axial pump having a swash plate, the variable displacement axial pump being configured to be driven by the motive power of the prime mover 32.

Each of the HST pumps 52L and 52R has a forward pressure-receiving portion 52*a* to which the pilot pressure is applied and a backward pressure-receiving portion 52*b* to which the pilot pressure is applied. And, the angle of the swash plate is changed by the pilot pressure applied to the pressure-receiving portions 52*a* and 52*b*. By changing the angle of the swash plate, it is possible to change an output (an output amount of the operation fluid) of the HST pumps 52L and 52R and an output direction of the operation fluid.

In other words, each of the HST pumps 52L and 52R changes the angle of the swash plate, and thereby changes the driving force outputted to the traveling device 5.

The first traveling motor mechanism 31L is a mechanism configured to transmit a power to the drive shaft of the traveling device 5 disposed on the left side of the machine body 2. The second traveling motor mechanism 31R is a mechanism configured to transmit a power to a drive shaft of the traveling device 5 disposed on the right side of the machine body 2. The first traveling motor mechanism 31L has an HST motor 36 (the traveling motor) 36 and a speed-changing mechanism.

The HST motor 36 is constituted of a variable displacement axial motor having a swash plate, the variable displacement axial being constituted of a motor configured to change a vehicle speed (a revolution speed) to a first speed or a second speed. In other words, the HST motor 36 is constituted of a motor configured to change a thrust power of the working machine 1.

The speed-changing mechanism includes a swash plate switching cylinder 38*a* and a travel switching valve 38*b*. The swash plate switching cylinder 38*a* is constituted of a cylinder configured to be stretched and shortened to change the angle of the swash plate of the HST motor 36. The travel switching valve 38*b* is constituted of a valve configured to stretch and shorten the swash plate switching cylinder 38*a* to one side of the swash plate switching cylinder 38*a* or the other side, specifically a two-position switching valve having a first position 39*a* and a second position 39*b* and being configured to be switched between the first position 39*a* and the second position 39*b*. The travel switching valve 38*b* is switched by a speed-changing switching valve 81*a*.

The speed-changing switching valve 81*a* is connected to the outputting fluid tube 40 and is connected to the travel switching valve 38*b* of the first traveling motor mechanism 31L and to the travel switching valve 38*b* of the second traveling motor mechanism 31R. The speed-changing switching valve 81*a* is constituted of a two-position switching valve having a first position 81*a*1 and a second position 81*a*2 and being configured to be switched between the first position 81*a*1 and the second position 81*a*2. When the speed-changing switching valve 81*a* is set to the first position 81*a*1, the pressure of the hydraulic fluid applied to the travel switching valve 38*b* of the speed-changing mechanism is set to a pressure corresponding to a predetermined speed (for example, the first speed).

In addition, when the speed-changing switching valve 81*a* is set to the first position 81*a*1, the pressure of the hydraulic fluid applied to the travel switching valve 38*b* is set to a pressure corresponding to a speed (the second speed) faster than being set to the pressure corresponding to the predetermined speed (the first speed). Thus, when the speed-changing switching valve 81*a* is in the first position 81*a*1, the travel switching valve 38*b* is set to the first position 39*a*, and thereby the swash plate switching cylinder 38*a* is shortened to set the HST motor 36 to the first speed.

In addition, when the speed-changing switching valve 81*a* is in the second position 81*a*2, the travel switching valve 38*b* is in the second position 39 *b*, and accordingly the swash plate switching cylinder 38*a* is stretched thereby to shift the HST motor 36 to the second speed. Meanwhile, the HST motor 36 is shifted to the first speed and to the second speed under the control of the control device 90.

For example, the control device 90 is provided with an operation member 58 such as a switch (a speed-changing switch). When the operation member 58 is switched to the first speed, the control device 90 outputs a control signal for demagnetizing the solenoid of the speed-changing switching valve 81*a* and thereby switches the speed-changing switching valve 81*a* to the first position 81*a*1. In addition, when the operation member 58 is switched to the second speed, the control device 90 outputs a control signal for magnetizing the solenoid of the speed-changing switching valve 81*a* and thereby switches the speed-changing switching valve 81*a* to the second position 81*a*2.

In addition, the first traveling motor mechanism 31L has a brake mechanism 30. The brake mechanism 30 is configured to brake the traveling device 5 disposed to the right, that is, to stop the rotation of the HST motor 36 or the rotation of the output shaft rotating in accordance with the rotation of the HST motor 36. Due to the pilot fluid (the operation fluid) outputted from the first hydraulic pump P1, the brake mechanism 30 shifts to an operating state in which the traveling motor mechanism 31 is braked or to an operating state in which the braking is released.

For example, the brake mechanism 30 includes a first disk disposed on the output shaft of the traveling motor mechanism 31, a second disk configured to be movable, and a spring configured to push the second disk toward the first disk. In addition, the brake mechanism 30 is provided with a housing portion (a housing case) 59 configured to house the first disc, the second disc, and the spring. In the housing portion 59, a portion in which the second disc is stored is connected to a brake switching valve 80*a* by a fluid tube as described below.

The brake switching valve 80*a* is constituted of a solenoid valve configured to carry out the braking and the release of braking (the brake releasing) in the brake mechanism 30, that is, a two-position switching valve configured to be switchable between a first position 80*a*1 and a second position 80*a*2. When the brake switching valve 80*a* is in the first position 80*a*1, the brake switching valve 80*a* regulates the pressure of the operation fluid to be applied to the brake mechanism 30 (the pressure applied to the housing portion 59) to the pressure at which the brake mechanism 30 carries out the braking. In addition, when the brake switching valve 80*a* is in the second position 80*a*2, the brake switching valve 80*a* is set to regulate the operation fluid to a pressure for the brake releasing.

The switching of the brake switching valve 80*a* is carried out under the control of the control device 90. For example, the controller 90 outputs a control signal for demagnetizing the solenoid of the brake switching valve 80*a*, and thereby sets the brake switching valve 80*a* to the first position 80*a*1.

In addition, the control device 90 outputs a control signal for magnetizing the solenoid of the brake switching valve 80*a*, and thereby sets the brake switching valve 80*a* to the second position 80*a*2. Further, the control device 90 may outputs the control signal to the brake switching valve 80*a*, for example, with use of a preliminarily-provided switch and with manually operating the switch. And, the control device 90 may automatically output the control signal through judgment of the driving situation of the working machine 1.

Thus, when the brake control valve 80*a* is in the first position 80*a*1, the pilot fluid in the storage portion of the housing portion 59 is outputted, the second disk moves in the direction of the braking, and thereby the braking is carried out in the brake mechanism 30. In addition, when the brake control valve 80*a* is in the second position 80*a*2, the pilot fluid is supplied to the storage portion of the housing portion 59, the second disk moves in a direction opposite to the direction of the braking (in a direction opposite to the biasing direction of the spring), and thereby the braking is released in the brake mechanism 30.

Meanwhile, since the second traveling motor mechanism 31R has the same configuration as that of the first traveling motor mechanism 31L, the configuration described in the first traveling motor mechanism 31L may be applied to the second traveling motor mechanism 31R. Thus, the explanation of the configurations will be omitted.

As shown in FIG. 1, the working machine 1 includes an operation device 53. The operation device 53 is a device configured to operate the traveling device 5, that is, the first traveling motor mechanism 31L, the second traveling motor mechanism 31R, and the travel driving circuit 34. The operation device 53 has a first operation member 54 and a plurality of operation valves 55 (55*a*, 55*b*, 55*c*, and 55*d*).

The first operation member 54 is an operation member that is supported by the operation valve 55 and is swung in the left-to-right direction (the machine width direction) or in the front-to-rear direction. In addition, the plurality of operation valves 55 are operated commonly, that is, by one first operation member 54. The plurality of operation valves 55 operate based on the swing of the first operation member 54. The operation fluid (the pilot fluid) can be supplied from the first hydraulic pump P1 to the plurality of operation valves 55 through the outputting fluid tube 40. The plurality of operation valves 55 includes the operation valve 55*a*, the operation valve 55*b*, the operation valve 55*c*, and the operation valve 55*d*.

The plurality of operation valves 55 and the traveling drive mechanism 34 for the traveling (the travel pumps 52L and 52R) are connected by a traveling fluid tube 45. The traveling fluid tube 45 includes a first traveling fluid tube 45*a*, a second traveling fluid tube 45*b*, a third traveling fluid tube 45*c*, a fourth traveling fluid tube 45*d*, and a fifth traveling fluid tube 45*e*. The first traveling fluid tube 45*a* is constituted of a fluid tube connected to the forward pressure-receiving portion 52*a* of the traveling pump 52L.

The second traveling fluid tube 45*b* is constituted of a fluid tube connected to the backward pressure-receiving portion 52*b* of the traveling pump 52L. The third traveling fluid tube 45*c* is constituted of a fluid tube connected to the forward pressure-receiving portion 52*a* of the travel pump 52R. The fourth traveling fluid tube 45*d* is constituted of a fluid tube connected to the backward pressure-receiving portion 52*b* of the traveling pump 52R.

The fifth traveling fluid tube 45*e* is constituted of a fluid tube connecting the operation valve 55, the first traveling fluid tube 45*a*, the second traveling fluid tube 45*b*, the third traveling fluid tube 45*c*, and the fourth traveling fluid tube 45*d* to each other. The fifth traveling fluid tube 45*e* connects a plurality of shuttle valves 46 and the plurality of operation valves 55 (55*a*, 55*b*, 55*c*, 55*d*) to each other.

When the first operation member 54 is swung forward (in the direction indicated by an arrowed line A1 in FIG. 1), the operation valve 55*a* is operated, and thereby the pilot pressure is outputted from the operation valve 55*a*. In this manner, the output shaft of the traveling motor 36 revolves forward at a speed proportional to a swinging amount (a swinging extent) of the first operation member 54, and thus the working machine 1 travels straight forward.

In addition, when the first operation member 54 is swung backward (in the direction indicated by an arrowed line A2 in FIG. 1), the operation valve 55*b* is operated, and thereby the pilot pressure is outputted from the operation valve 55*b*. In this manner, the output shaft of the traveling motor 36 revolves backward at a speed proportional to a swinging amount (a swinging extent) of the first operation member 54, and thus the working machine 1 travels straight backward.

In addition, when the first operation member 54 is swung to the right (the direction indicated by an arrowed line A3 in FIG. 1), the operation valve 55*c* is operated to output the pilot pressure from the operation valve 55*c*, and thereby the output shaft of the traveling motor 36 on the left side rotates in the forward direction, the output shaft of the running motor 36 on the right side rotates in the reverse direction, and thereby the working machine 1 turns to the right.

When the first operation member 54 is swung to the left (the direction indicated by an arrowed line A4 in FIG. 1), the operation valve 55*d* is operated to output the pilot pressure from the operation valve 55*d*, and thereby the output shaft of the traveling motor 36 on the left side rotates in the reverse direction, the output shaft of the running motor 36 on the right side rotates in the forward direction, and thereby the working machine 1 turns to the left.

In addition, when the first operation member 54 is swung in the oblique direction, the differential pressure between the pilot pressure applied to the pressure-receiving portion 52*a* and the pilot pressure applied to the pressure-receiving portion 52*b* determines the rotation directions and the rotation speeds of the output shafts of the traveling motor 36 on the left and the traveling motor 36 on the right, and thereby the working machine 1 turns rightward or leftward while moving forward or backward.

Next, the operating hydraulic system will be described below.

Figure 2:
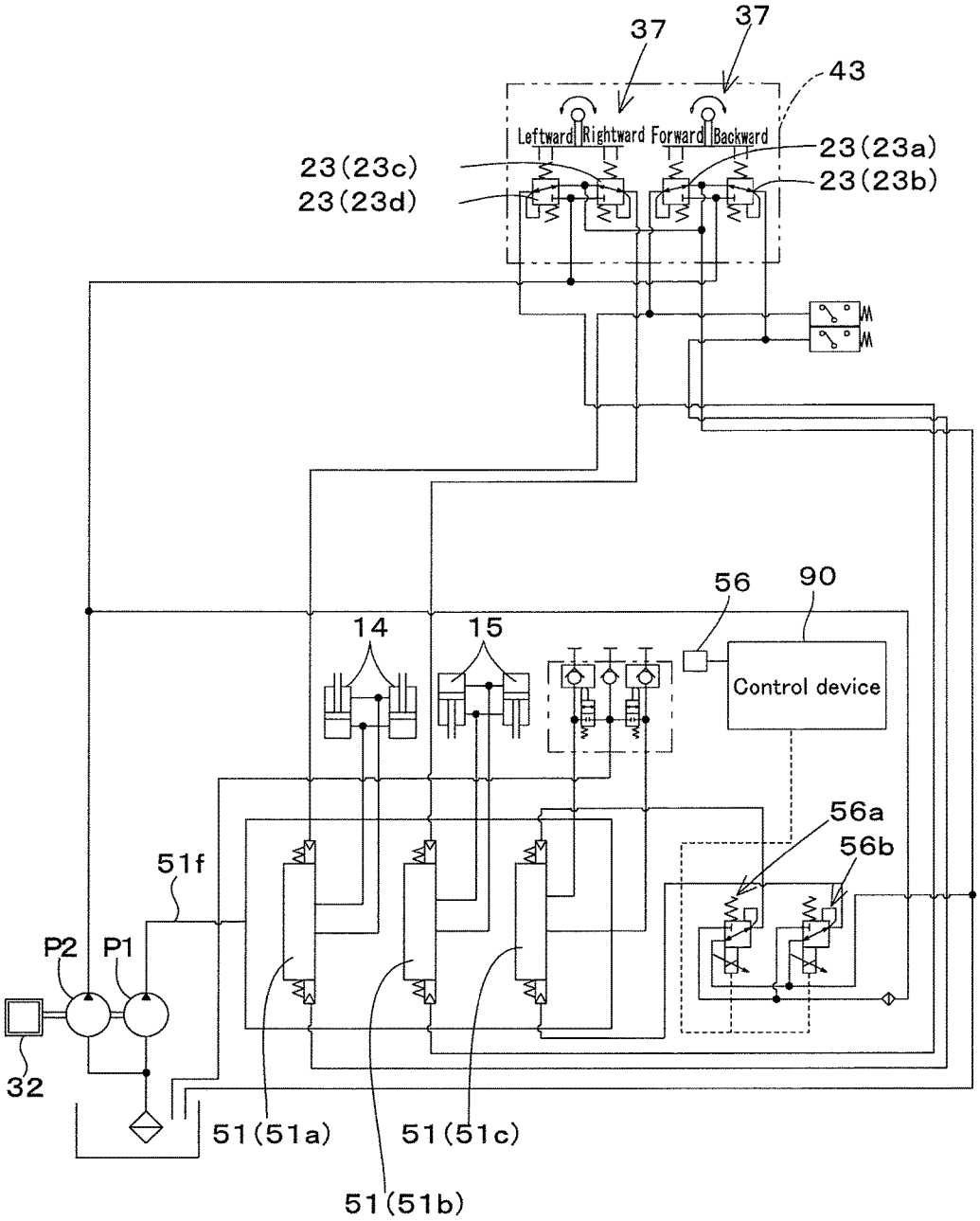
FIG. 2 is a view illustrating an operating hydraulic system (a hydraulic circuit) for the working machine according to the first embodiment.

As shown in FIG. 2, the operating hydraulic system is a system configured to operate the boom 10, the bucket 11, the auxiliary attachment and the like, and includes a plurality of control valves 51 and an operating hydraulic pump (a second hydraulic pump P2).

The second hydraulic pump P2 is arranged on a position different from the position of the first hydraulic pump P1, and is constituted of a low-displacement gear pump. The second hydraulic pump P2 is configured to output the operation fluid stored in the operation fluid tank. In particular, the second hydraulic pump P2 outputs the operation fluid mainly used for the operation of the hydraulic actuator.

On the outputting side of the second hydraulic pump P2, an operation fluid tube 51*f* is disposed. A plurality of control valves 51 are connected to the operation fluid tube 51*f*. The boom control valve 51*a* is constituted of a valve configured to control the boom cylinder 14, the bucket control valve 51*b* is a valve configured to control the bucket cylinder 15, and the auxiliary control valve 51*c* is a valve configured to control the hydraulic actuator of the auxiliary attachment.

The operation of the boom 10 and the bucket 11 are operated by the second operation member 37 connected to the operation device 43. The second operation member 37 is constituted of an operation member supported by the operation valve 23 and configured to swing in the lateral direction (the machine width direction) or in the front-to-rear direction. By tilting the second operation member 37, each of the operation valves 23 arranged on the lower portion of the second operation member 37 is operated.

When the second operation member 37 is tilted forward and backward, the downward-moving operation valve 23*a* is operated to output the pilot pressure from the downward-moving operation valve 23*a*. The pilot pressure applied to the pressure-receiving portion of the boom control valve 51*a*, the hydraulic fluid entering the boom control valve 51*a* is supplied to the rod side of the boom cylinder 14, and thereby the boom 10 is moved downward.

When the second operation member 37 is tilted backward, the upward-moving operation valve 23*b* is operated to output the pilot pressure from the upward-moving operation valve 23*b*. The pilot pressure is applied to the pressure-receiving portion of the boom control valve 51*a*, the operation fluid entering the boom control valve 51*a* is supplied to the bottom side of the boom cylinder 14, and thereby the boom 10 is moved upward.

That is, the boom control valve 51*a* is configured to control the flow rate of the hydraulic fluid flowing through the boom cylinder 14 in accordance with the pressure of the operation fluid set by the operation of the second operation member 37 (the pilot pressure set by the downward-moving operation valve 23*a* and the pilot pressure set by the upward-moving operation valve 23*b*).

When the second operation member 37 is tilted rightward, the operation valve 23*c* for the bucket dumping is operated, and thereby the pilot pressure is applied to the pressure-receiving portion of the bucket control valve 51*b*. As the result, the bucket control valve 51*b* operates in a direction to stretch the bucket cylinder 15, and thereby the bucket 11 performs the dumping movement at a speed proportional to the tilting amount of the second operation member 37.

When the second operation member 37 is tilted leftward, the operation valve 23*d* for the bucket shoveling is operated, and thereby the pilot fluid is applied to the pressure-receiving portion of the bucket control valve 51*b*. As the result, the bucket control valve 51*b* operates in a direction to shorten the bucket cylinder 15, and thereby the bucket 11 performs the shoveling operation at a speed proportional to the tilting amount of the second operation member 37.

In other words, the bucket control valve 51*b* controls the flow rate of the operation fluid flowing through the bucket cylinder 15 in accordance with the pressure of the operation fluid set by the operation of the second operation member 37 (the pilot pressure set by the operation valve 23*c* and the pilot pressure set by the operation valve 23*d*). That is, the operation valves 23*a*, 23*b*, 23*c*, and 23*d* change the pressure of the hydraulic fluid in accordance with the operation of the second operation member 37 and thereby supply the hydraulic fluid already changed to the control valves such as the boom control valve 51*a*, the bucket control valve 51*b*, and the auxiliary control valve 51*c*.

The operation of the auxiliary attachment is carried out by a switch 56 disposed around the operator seat 8. The switch 56 is constituted of, for example, a swingable seesaw type switch, a slidable slide type switch, or a pressable push type switch. The operation of the switch 56 is inputted to the control device 90. The first solenoid valve 56*a* and the second solenoid valve 56*b* each composed of solenoid valves and the like are opened in accordance with the operation amount of the switch 56.

As the result, the pilot fluid is supplied to the auxiliary control valve 51*c*, the auxiliary control valve 51*c* being connected to the first solenoid valve 56*a* and the second solenoid valve 56*b*. And, the auxiliary actuator of the auxiliary attachment is operated by the hydraulic fluid supplied from the auxiliary control valve 51*c*.

Meanwhile, the hydraulic system for the working machine 1 connects the first fluid tube connected to the first hydraulic apparatus to the second fluid tube connected to the second hydraulic apparatus with the third fluid tube, and thereby helping the warming-up. In this embodiment, the first fluid tube, the second fluid tube, and the third fluid tube will be described on the assumption that the first hydraulic apparatus is constituted of a brake mechanism 30 and a speed-changing mechanism.

Figure 3A:
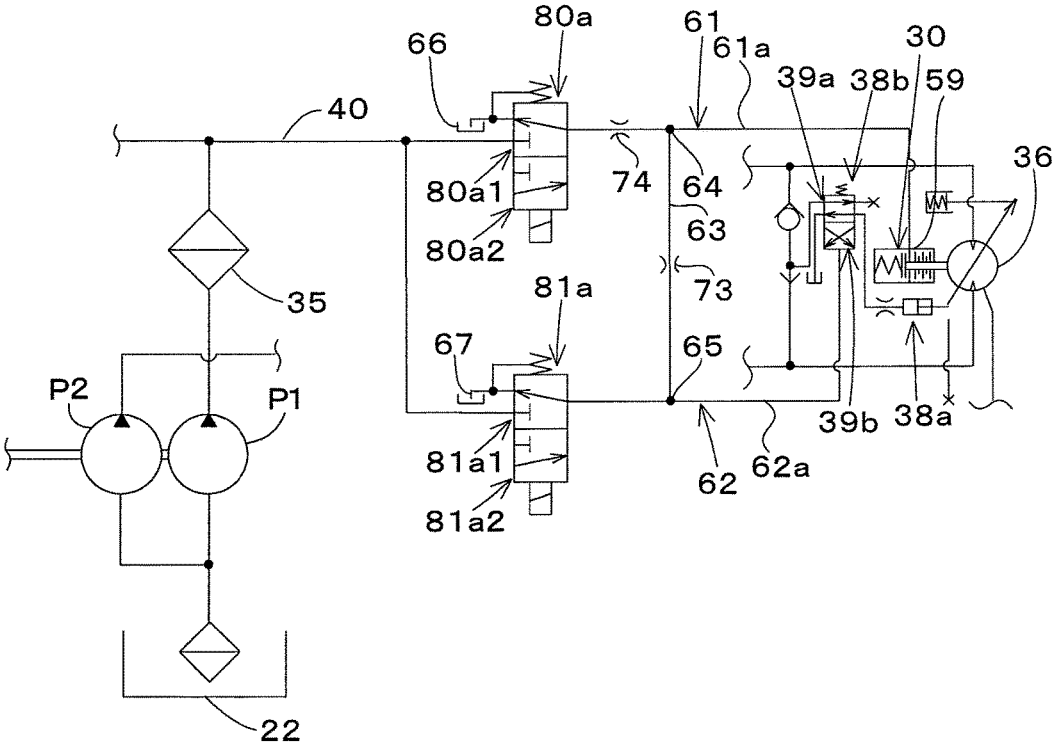
FIG. 3A is a partially-enlarged view illustrating the traveling hydraulic system for the working machine according to the first embodiment.

As shown in FIG. 1 and FIG. 3A, the first fluid tube 61 is constituted of a fluid tube connecting a first hydraulic apparatus (the brake mechanism 30) to a first operation valve (the brake switching valve) 80*a* for controlling the operation fluid supplied to the first hydraulic apparatus (the brake mechanism 30). In this embodiment, the first fluid tube 61 includes a first brake fluid tube 61*a* and a second brake fluid tube 61*b*.

The first brake fluid tube 61*a* is constituted of a fluid tube connecting the brake mechanism 30 of the first traveling motor mechanism 31L to the brake switching valve (the first operation valve) 80*a*. The second brake fluid tube 61*b* is constituted of a fluid tube connecting the brake mechanism 30 of the second traveling motor mechanism 31R to the brake switching valve (the first operation valve) 80*a*. The first brake fluid tube 61*a* and the second brake fluid tube 61*b* are confluent with each other in the intermediate portion, and a fluid tube 61*c* after the confluent portion (that is, a fluid tube (a shared fluid tube) shared with both of the first brake fluid tube 61*a* and the second brake fluid tube 61*b*) is connected to a brake switching valve 80*a*.

The shared fluid tube 61*c* is provided with a throttling portion 74 configured to reduce the flow rate of the operation fluid. In other words, the throttling portion 74, in the first fluid tube 61*a*, is connected to a section between a connecting portion (that is, a confluent portion 64 described below) where the third fluid tube 63 is connected to the first fluid tube 61 and another connecting portion connected to the throttle portion 80*a*.

The output port of the brake switching valve 80*a* is connected to an outputting fluid tube 66 configured to output the operation fluid of the first fluid tube 61 (the first brake fluid tube 61*a* and the second brake fluid tube 61*b*). The outputting fluid tube 66 is connected to the suction port of the hydraulic pump, to the operation fluid tank 22, and the like.

The second fluid tube 62 is constituted of a fluid tube connecting the second hydraulic device (the speed-changing mechanism) to the second operation valve (the speed-changing switching valve) 81*a* configured to control the operation fluid, the operation fluid being supplied to the first hydraulic apparatus (the speed-changing mechanism). In this embodiment, the second fluid tube 62 includes a first speed-changing fluid tube 62*a* and a second speed-changing fluid tube 62*b*.

The first speed-changing fluid tube 62*a* is constituted of a fluid tube connecting the speed-changing switching valve (the second operation valve) 81*a* to the travel switching valve 38*b* of the speed-changing mechanism in the first traveling motor mechanism 31L. The second speed-changing fluid tube 62*b* is constituted of a fluid tube connecting the speed-changing switching valve (the second operation valve) 81*a* to the travel switching valve 38*b* of the speed-changing mechanism in the second traveling motor mechanism 31R.

The first speed-changing fluid tube 62*a* and the second speed-changing fluid tube 62*b* are confluent with each other in the intermediate portion, and a fluid tube after the confluent portion is connected to a speed-changing switching valve 81*a*. The output port of the speed-changing switching valve 81*a* is connected to an outputting fluid tube 67 configured to output the operation fluid of the second fluid tube 62 (the first speed-changing fluid tube 62*a* and the second speed-changing fluid tube 62*b*). The outputting fluid tube 67 is connected to the suction port of the hydraulic pump, to the operation fluid tank 22, and the like.

The third fluid tube 63 is constituted of a fluid tube connecting the first fluid tube 61 and the second fluid tube 62 to each other. The third fluid tube 63 connects, to each other, a confluent portion 64 where the first brake fluid tube 61*a* and the second brake fluid tube 61*b* are confluent with each other and a confluent portion 65 where the first speed-changing fluid tube 62*a* and the second speed-changing fluid tube 62*b* are confluent with each other. The third fluid tube 63 is provided with a throttling portion 73 configured to reduce the flow rate of the operation fluid.

As described above, when the speed-changing switching valve (the second operation valve) 81*a* is set to the first speed and the brake switching valve 80*a* is set to the second position 80*a*2 for example, the hydraulic fluid in the first fluid tube 61 flows to the second fluid tube 62 through the third fluid tube 63 and is outputted from the output port of the speed-changing switching valve 81*a* to the outputting fluid tube 67. Thus, it is possible to warm up the first fluid tube (the brake fluid tube) and the second fluid tube (the speed-changing fluid tube).

That is, the first fluid tube 61 and the second fluid tube 62 are connected to each other by the third fluid tube 63, the first fluid tube 61 connecting the brake switching valve 80*a* and the brake mechanism 30 to each other, the second fluid tube 62 connecting the speed-changing switching valve 81*a* and the speed-changing mechanism (the travel switching valve 38*b*) to each other. Then, the outputting fluid tubes 66 and 67 are provided, the outputting fluid tubes 66 and 67 being configured to output the hydraulic fluid from any one of the first fluid tube 61 and the second fluid tube 62, and thereby it is possible to easily warm up the first fluid tube 61 and the second fluid tube 62.

In particular, the brake switching valve 80*a* is constituted of a switching valve configured to be switched between the first position 80*a*1 and the second position 80*a*2, and the speed-changing switching valve 81*a* is constituted of a switching valve configured to be switched between the first position 81*a*1 and the second position 81*a*2. In this manner, the warming-up is simply carried out by switching both of the switching valves.

For example, the control device 90 controls the first operation valve 80*a* and the second operation valve 81*a*, and thereby introduces the operation fluids of the first fluid tube 61 and the second fluid tube 62 to the outputting fluid tube through the third fluid tube, thereby warming up the hydraulic fluid. When the warming up of the hydraulic fluid is carried out, the control device 90 switches the speed-changing switching valve (the second operation valve) 81*a* to the first position 81*a*1, and switches the brake switching valve (the first operation valve) 80*a* to the second position 80*a*2.

In this manner, the hydraulic fluid in the first fluid tube 61 flows to the second fluid tube 62 through the third fluid tube 63, and is outputted from the output port of the speed-changing switching valve 81*a* to the outputted fluid tube 67, and thereby the operation fluid is warmed up while the working machine 1 travels at the first speed.

Figure 3B:
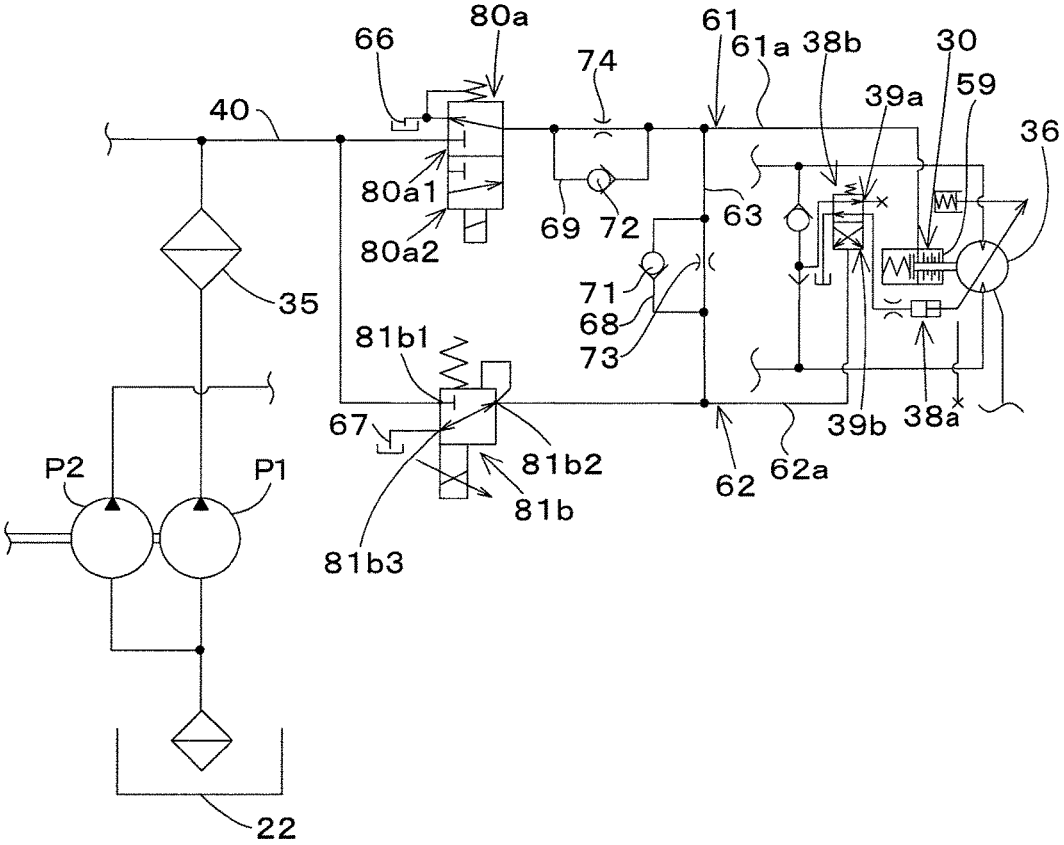
FIG. 3B is a view illustrating a first modified example of the traveling hydraulic system illustrated in FIG. 3A according to the first embodiment.

FIG. 3B is a view showing a first modification example of the hydraulic system shown in FIG. 3A. Meanwhile, for convenience of the explanation, FIG. 3B shows the fluid tubes (the first brake fluid tube 61*a* and the first speed-changing fluid tube 62*a*) disposed on the side of the first traveling motor mechanism 31L, and the fluid tubes (the second brake fluid tube 61*b* and the second speed-changing fluid tube 62*b*) disposed on the side of the second traveling motor mechanism 31R are omitted. The configuration of the fluid tubes (the first brake fluid tube 61*a* and the first speed-changing fluid tube 62*a*) disposed on the side of the first traveling motor mechanism 31L may be employed in the fluid tube disposed on the side of the second traveling motor mechanism 31R.

As shown in FIG. 3B, the first modification describes an example in which the travel switching valve (the second operation valve) 81*a* is replaced by a speed-changing proportional valve 81*b*, the speed-changing proportional valve 81*b* being constituted of an electromagnetic proportional valve. The control of the speed-changing proportional valve 81*b* is carried out by the control of the control device 90. For example, when the operation member 58 is switched to the first speed, the control device 90 outputs a control signal to the speed-changing proportional valve 81*b*, and thereby sets the opening aperture of the speed-changing proportional valve 81*b* to the opening aperture corresponding to the first speed.

In other words, the speed-changing proportional valve 81*b* sets the pressure of the hydraulic fluid applied to the travel switching valve 38*b* (the pressure applied to the pressure-receiving portion of the travel switching valve 38*b*) to a pressure required to keep the travel switching valve 38*b* in the first position 81*a*1. When the operation member 58 is switched to the second speed, the control device 90 outputs a control signal to the speed-changing proportional valve 81*b*, and thereby sets the opening aperture of the speed-changing proportional valve 81*b* to be larger than the opening aperture corresponding to the first speed.

That is, the speed-changing proportional valve 81*b* sets the pressure of the hydraulic fluid applied to the travel switching valve 38*b* (the pressure applied to the pressure-receiving portion of the travel switching valve 38*b*) to a pressure required to keep the travel switching valve 38*b* in the second position 81*a*2. That is, the speed-changing proportional valve 81*b* sets the pressure of the hydraulic fluid supplied to the travel switching valve 38*b* of the speed-changing mechanism to a pressure required to change the speed of the speed-changing mechanism.

The speed-changing proportional valve 81*b* has a primary port (a pump port) 81*b*1 and a secondary port 81*b*2. The primary port 81*b*1 of the speed-changing proportional valve 81*b* is connected to the outputting fluid tube 40. The secondary port 81*b*2 of the speed-changing proportional valve 81*b* is connected to the second fluid tube 62 (the first speed-changing fluid tube 62*a* and the second speed-changing fluid tube 62*b*). The output port 81*b*3 of the speed-changing proportional valve 81*b* is connected to the operation fluid tank 22 by an outputting fluid tube 67.

A first bypass fluid tube 68 is connected to the third fluid tube 63. The first bypass fluid tube 68 is provided with a first check valve 71. The first check valve 71 is constituted of a valve configured to allow the hydraulic fluid to flow from the second fluid tube 62 to the first fluid tube 61 and to block the hydraulic fluid from flowing from the first fluid tube 61 toward the second fluid tube 62.

The second bypass fluid tube 69 is connected to the first fluid tube 61 between the brake switching valve 80*a* and the third fluid tube 63. The second bypass fluid tube 69 is provided with a second check valve 72. The second check valve 72 is constituted of a valve configured to allow the hydraulic fluid to flow from the connecting portion between the first fluid tube 61 and the third fluid tube 63 to the brake switching valve 80*a* and to block the fluid tube from flowing from the brake switching valve 80*a* toward the connecting portion.

Meanwhile, the third fluid tube 63 is provided with the first bypass fluid tube 68 and the first check valve 71. However, the third fluid tube 63 may be not provided with the first bypass fluid tube 68 and the first check valve 71. In addition, the first fluid tube 61 is provided with the second bypass fluid tube 69 and the second check valve 72. However, the first fluid tube 61 may be not provided with the second bypass fluid tube 69 and the second check valve 72. Alternatively, the hydraulic system for the working machine 1 may include the first bypass fluid tube 68 and the first check valve 71 or include the second bypass fluid tube 69 and the second check valve.

As described above, In the case where the pressure at which the travel switching valve 38*b* is switched to the second position 81*a*2 is a pressure to set the second speed, the opening aperture of the speed-changing proportional valve 81*b* is set so that the pressure applied to the travel switching valve 38*b* does not exceed the pressure to set the second speed under the state where the brake switching valve 80*a* is set to the first position 80*a*1 and the brake mechanism 30 performs the braking.

In this manner, the hydraulic fluid of the second fluid tube 62 passes through the first bypass fluid tube 68 and the second bypass fluid tube 69 and then is outputted from the outputting fluid tube 66 connected to the brake switching valve 80*a*. For example, in the warming-up of the hydraulic fluid, the control device 90 switches the brake switching valve 80*a* to the first position 80*a*1, and then sets the opening aperture of the speed-changing proportional valve 81*b* so as not to switch the travel switching valve 38*b* to the second position 39*b* (sets the applied pressure to be less than the pressure to set the second speed).

In addition, in the case where the brake switching valve 80*a* is set to the second position 80*a*2 and then the brake mechanism 30 releases the braking, the opening aperture of the speed-changing proportional valve 81*b* is adjusted such that the pressure applied to the travel switching valve 38*b* by the speed-changing proportional valve 81*b* is equal to or more than the pressure to set the second speed and less than the pressure applied to the primary port 81*b*1 of the speed-changing proportional valve 81*b*.

For example, in the case where the pressure of the hydraulic fluid applied to the primary port 81*b*1 of the speed-changing proportional valve 81*b* is 2.8 MPa and the pressure to set the second speed is 1.0 MPa, the pressure of the hydraulic fluid applied to the secondary port 81*b*2 of the speed-changing proportional valve 81*b* is 1.8 MPa and the like. In this manner, the operation fluid of the first fluid tube 61 is supplied to the third fluid tube 63 and the second fluid tube 62, and thus is outputted from the outputting fluid tube 67 connected to the speed-changing proportional valve 81*b*.

For example, a first measuring device and a second measuring device are connected to the control device 90, the first measuring device being configured to measure a pressure (a first pressure) applied to the primary port 81*b*1 of the speed-changing proportional valve 81*b*, the second measuring device being configured to measure a pressure (a second pressure) applied to the secondary port 81*b*2 of the speed-changing proportional valve 81*b*.

For example, the first measuring device is disposed on the outputting fluid tube 40 in the vicinity of the brake switching valve 80*a*. In addition, the second measuring device is disposed on the second fluid tube 62. For example. it is preferred for the second fluid tube 62 to dispose the second measuring device in the vicinity of the pressure-receiving portion of the travel switching valve 38*b*. The first pressure is measured based on the distance from the first measuring device to the primary port 81*b*1 of the speed-changing proportional valve 81*b* and in accordance with the calculation a pressure loss of the outputting fluid tube 40 calculated by the control device 90 and the like with respect to the measured value measured by the first measuring device.

In addition, since the pressure on the primary side (the first pressure) can be estimated based on the revolution speeds of the first hydraulic pump P1, the engine, and the like, the first measuring device may be omitted. In addition, since the pressure on the operation fluid applied to the travel switching valve 38*b* can be estimated based on the operating condition such as the temperature of the operation fluid, the revolution speed of the engine, and the like, the second measuring device may be omitted.

In the warming-up of the hydraulic fluid, the control device 90 switches the brake switching valve 80*a* to the second position 80*a*2 and sets the opening aperture of the speed-changing proportional valve 81*b*. Here, in the case where the control device 90 sets the opening aperture of the speed-changing proportional valve 81*b*, the control device 90 sets the opening aperture of the speed-changing proportional valve 81*b* so that the first pressure is equal to or lower than the second pressure and the pressure applied to the travel switching valve 38*b* is equal to or higher than the pressure to set the second speed.

In addition, in the case where the brake switching valve 80*a* is set to the second position 80*a*2 and thus releases the braking carried out by the brake mechanism 30, the opening aperture of the speed-changing proportional valve 81*b* is adjusted so as to set the pressure applied to the travel switching valve 38*b* by the speed-changing proportional valve 81*b* to be less than the pressure to set the second speed and to be the pressure to set the first speed. In that case, the operation fluid of the first fluid tube 61 passes through the third fluid tube 63, and then is outputted from the outputting fluid tube 67 of the speed-changing proportional valve 81*b*.

For example, In the case where the hydraulic fluid is warmed up, the control device 90 switches the brake switching valve 80*a* to the first position 80*a*1 and adjusts the opening aperture of the speed-changing proportional valve 81*b* so as to set the travel switching valve 38*b* to be in the first position 39*a*.

Figure 3C:
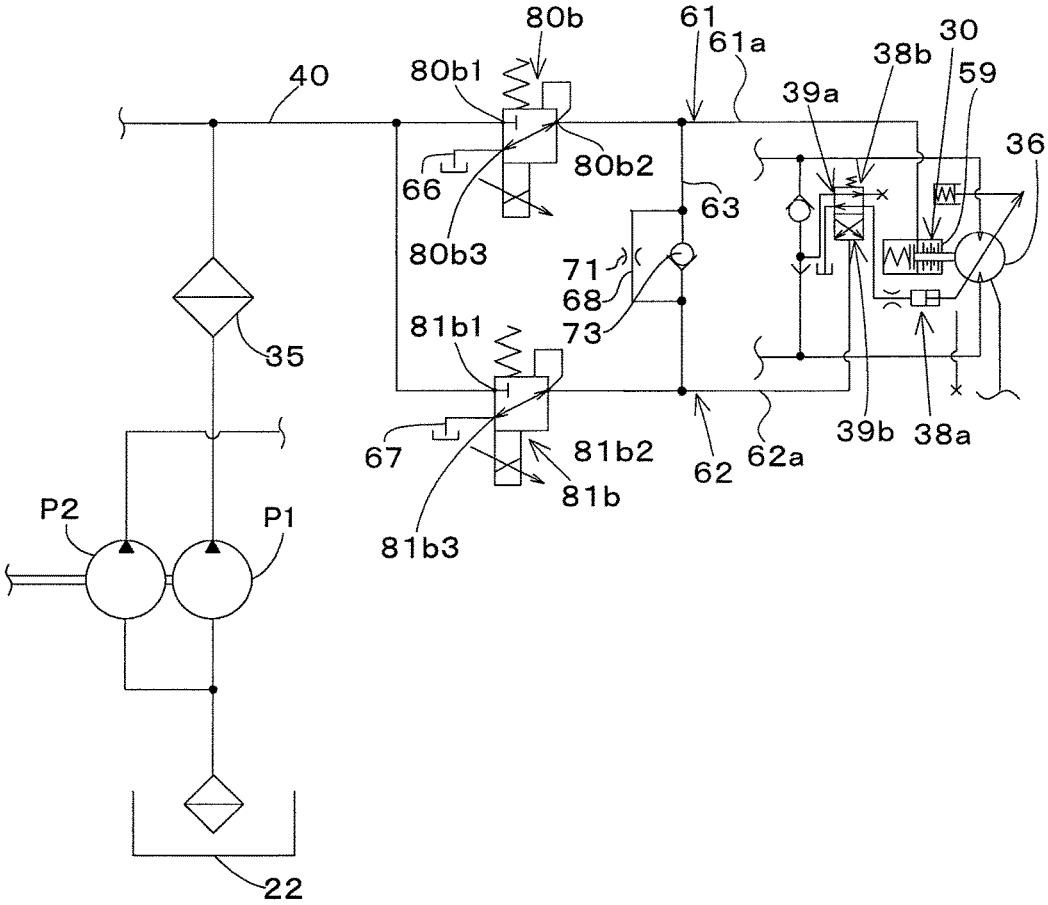
FIG. 3C is a view illustrating a second modified example of the traveling hydraulic system illustrated in FIG. 3B according to the first embodiment.

FIG. 3C shows a second modification of the hydraulic system shown in FIG. 3B. As shown in FIG. 3C, the second modified example describes an example in which the brake switching valve (the first operation valve) 80*a* is replaced by an electromagnetic proportional valve (the brake switching valve) 80*b*.

In the case where the braking is released by the brake mechanism 30, the control device 90 outputs a control signal to the brake proportional valve 80*b*, and thereby sets the opening aperture of the brake proportional valve 80*b* to the opening aperture corresponding to the pressure (the brake releasing pressure) at which the brake mechanism 30 releases the braking. For example, in the case where the brake mechanism 30 carries out the braking, the control device 90 sets the opening aperture of the brake proportional valve 80*b* to the maximum extent (fully opens the brake proportional valve 80*b*).

Additionally, in the case where the brake mechanism 30 carries out the braking, the control device 90 outputs a control signal to the brake proportional valve 80*b*, and thereby sets the opening aperture of the brake proportional valve 80*b* to the opening aperture corresponding to the brake releasing pressure. For example, in the case where the brake mechanism 30 carries out the brake releasing, the control device 90 sets the opening aperture of the brake proportional valve 80*b* to the minimum extent (fully closes the brake proportional valve 80*b*).

The brake proportional valve 80*b* has a primary port (a pump port) 80*b*1 and a secondary port 80*b*2. The primary port 80*b*1 of the brake proportional valve 80*b* is connected to the outputting fluid tube 40. The secondary port 80*b*2 of the brake proportional valve 80*b* is connected to the first fluid tube 61. The outputting port 80*b*3 of the brake proportional valve 80*b* is connected to the operation fluid tank 22 through the outputting fluid tube 66.

As described above, the speed-changing proportional valve 81*b* is fully opened, and thereby the brake proportional valve 80*b* is set to be switched at a pressure equal to or higher than the brake releasing pressure and lower than the pressure applied to the primary port 80*b*1. In this manner, the operation fluid of the second fluid tube 62 is supplied to the third fluid tube 63 and then to the first fluid tube 61 sequentially, and then is outputted from the outputting fluid tube connected to the brake proportional valve 80*b*.

For example, a third measuring device and a fourth measuring device are connected to the control device 90, the third measuring device being configured to measure the pressure (a third pressure) applied to the primary port 80*b*1 of the brake proportional valve 80*b*, the fourth measuring device being configured to measure the brake releasing pressure. For example, the third measuring device is disposed in the vicinity of the pump port side of the speed-changing proportional valve 81*b*, and the fourth measuring device is disposed on the first fluid tube 61. In the case where the hydraulic fluid is warmed up, the control device 90 sets the opening aperture of the speed-changing proportional valve 81*b* to be fully opened, and thereby the opening aperture of the brake proportional valve 80*b* is set to provide the pressure of the operation fluid applied to the brake mechanism 30, the pressure being equal to or higher than the brake releasing pressure and equal to or lower than the third pressure.

In addition, in the case where the warming-up of the hydraulic fluid is carried out by the control device 90, the brake proportional valve 80*b* may be closed to set the braking state, and additionally the speed-changing proportional valve 81*b* may be opened. Also in that case, the operation fluid of the second fluid tube 62 is supplied to the third fluid tube 63 and then to the first fluid tube 61 sequentially, and then is outputted from the outputting fluid tube 66 connected to the brake proportional valve 80*b*.

Figure 3D:
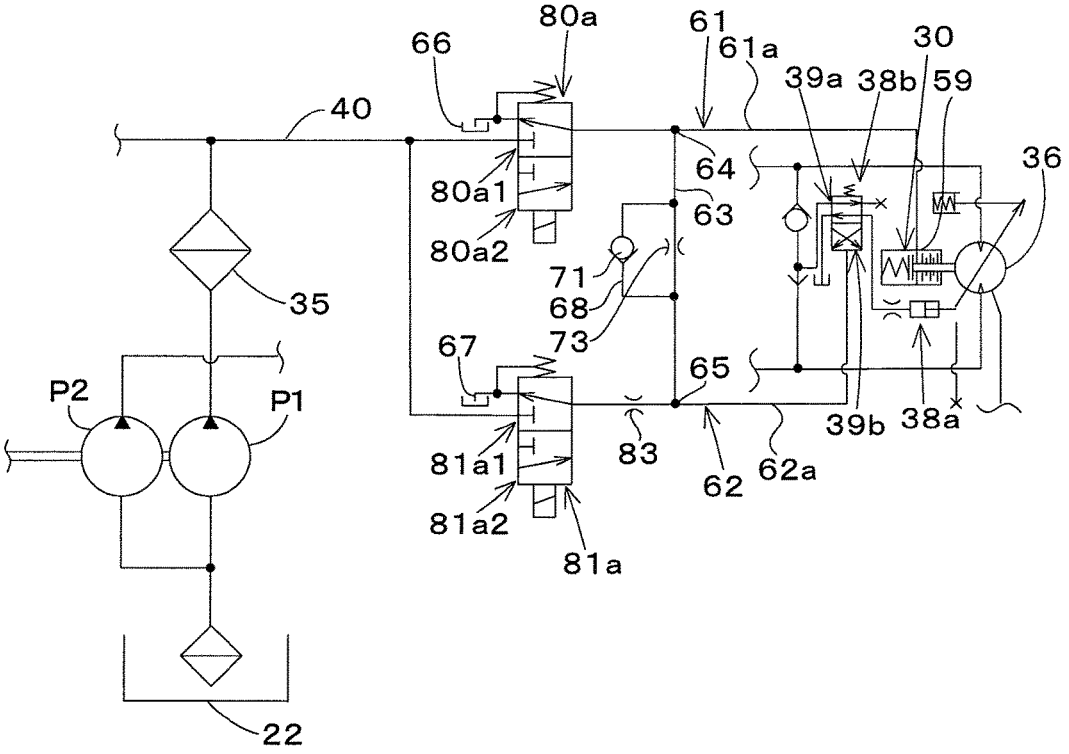
FIG. 3D is a view illustrating a third modified example of the traveling hydraulic system illustrated in FIG. 3A according to the first embodiment.

In addition, FIG. 3D shows a third modified example of the hydraulic system shown in FIG. 3A. The third modified example provides the throttling portion 73 on the third fluid tube 63, provides the first bypass fluid tube 68 on the third fluid tube 63, and provides the first check valve 71 on the first bypass fluid tube 68 in the hydraulic circuit provided with the brake switching valve 80*a* and the speed-changing switching valve 81*a*. In addition, the throttling portion 83 is provided on a section between the speed-changing switching valve 81*a* and the confluent portion 65 in the second fluid tube 62*a*.

In that case, the control device 90 carries out the braking performed by the brake mechanism 30 and switches the speed-changing switching valve 81*a* to the second position 81*a*2, and thereby the hydraulic fluid of the second fluid tube 62 is supplied to the first bypass fluid tube 68 through the first check valve 71, and is outputted to the outputting fluid tube 66 of the brake switching valve 80*a*.

Second Embodiment

Figure 4:
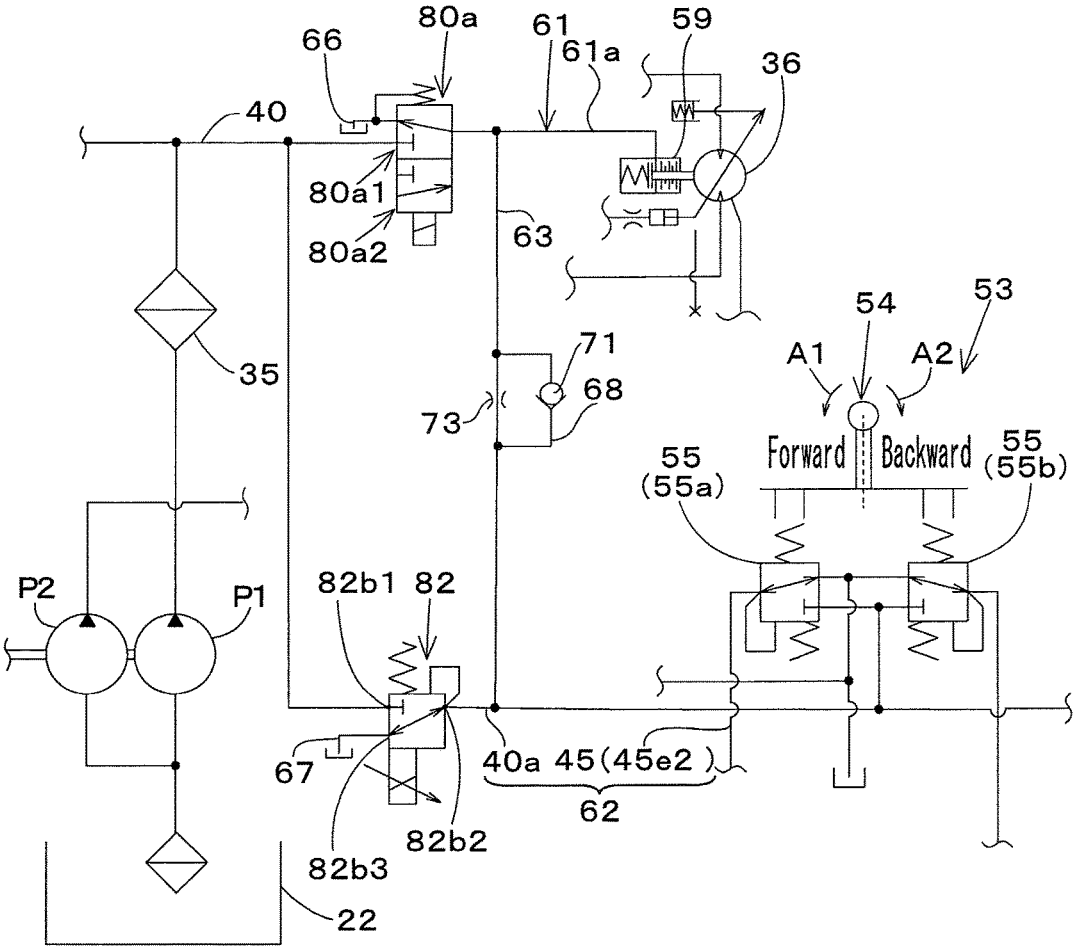
FIG. 4 is a partially-enlarged view illustrating a traveling hydraulic system for a working machine according to a second embodiment of the present invention.

FIG. 4 shows a hydraulic system according to a second embodiment of the present invention. The traveling hydraulic system shown in the second embodiment can be employed in the hydraulic system according to the first embodiment described above, and is configured to be warmed up easily. Configurations similar to those of the first embodiment will be omitted.

In the hydraulic system according to the second embodiment, a control for preventing the engine stall (an anti-stalling control) is carried out. A proportional valve (hereinafter referred to as anti-stalling proportional valve) 82 is disposed on the outputting fluid tube 40, specifically on the path of the operating device 53, and the anti-stalling proportional valve 82 is controlled to carry out the anti-stalling control.

Figure 5:
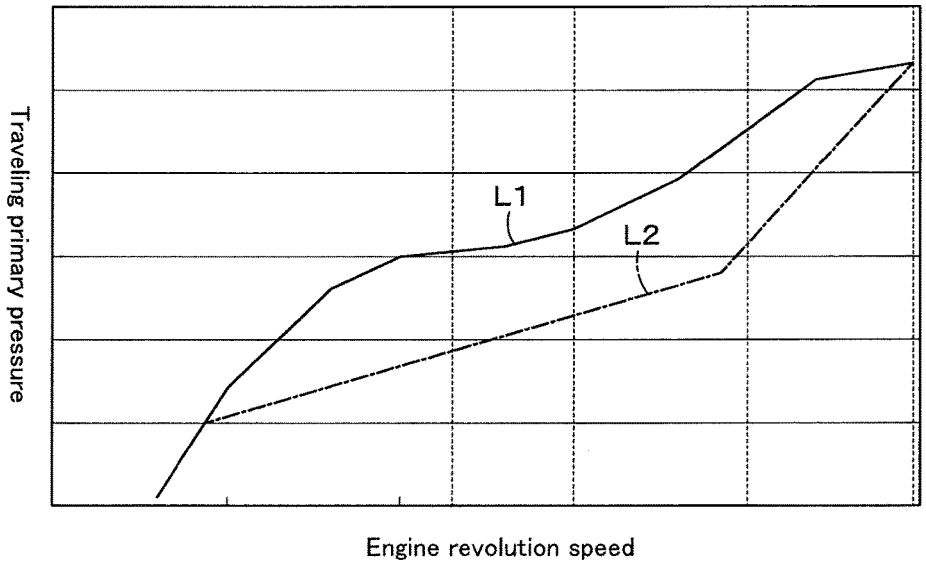
FIG. 5 is a view illustrating a relation between an engine revolution speed and a traveling primary pressure according to the second embodiment.

FIG. 5 shows the relation between the engine revolution speed, the traveling primary pressure, and the control lines L1 and L2. The traveling primary pressure is a pressure of the operation fluid (that is, the pilot pressure) in the section extending from the anti-stalling proportional valve 82 to the operation valves 55 (the operation valve 55*a*, the operation valve 55*b*, the operation valve 55*c*, and the operation valve 55*d*) in the outputting fluid tube 40.

That is, the traveling primary pressure is the primary pressure of the hydraulic fluid flowing into the operation valve 55 disposed on the operating lever 54. The control line L1 shows the relation between the engine revolution speed and the traveling primary pressure under the state where the dropping amount is less than a predetermined amount. The control line L2 shows the relation between the engine revolution speed and the traveling primary pressure under the state where the dropping amount is equal to or larger than the predetermined amount.

When the dropping amount is less than the predetermined amount, the control device 90 controls an opening aperture of the anti-stalling proportional valve 82 such that the relation between the actual revolution speed of the engine and the traveling primary pressure corresponds to the control line L1. In addition, when the dropping amount is equal to or larger than the predetermined value, the control device 90 controls the opening aperture of the anti-stalling proportional valve 82 so that the relation between the actual revolution speed of the engine and the traveling primary pressure corresponds to the control line L2.

In the control line L2, the traveling primary pressure for a predetermined engine revolution speed is lower than the traveling primary pressure of the control line L1. That is, when paying attention to the same engine speed, the traveling primary pressure of the control line L2 is lower than the traveling primary pressure of the control line L1. Thus, by the control based on the control line L2, the pressure (the pilot pressure) of the hydraulic fluid flowing into the operation valve 55 is suppressed to be low. As the result, the angle of the swash plate of the HST pump (the traveling pump) 52 is adjusted, a load applied to the engine is reduced, and thereby the stalling of the engine is prevented.

Meanwhile, FIG. 5 shows one control line L2. However, a plurality of the control lines L2 may be employed. For example, the control line L2 may be provided for each engine revolution speed. In addition, it is preferred that the control device 90 has data indicating the control lines L1 and control lines L2, control parameters such as functions, and the like.

The anti-stalling proportional valve 82 has a primary port (pump port) 82*b*1 and a secondary port 82*b*2. A primary port 82*b*1 of the anti-stalling proportional valve 82 is connected to an intermediate portion of the outputting fluid tube 40, and a secondary port 82*b*2 is connected to a section (40*a*) extending from the intermediate portion of the outputting fluid tube 40 to the operation valve 55 of the operation device 53 in the outputting fluid tube 40. An outputting fluid tube 67 is connected to the output port 82*b*3.

In the second embodiment, the first hydraulic apparatus is constituted of a brake mechanism 30, which is the HST pump 52, that is, the traveling drive mechanism 34. The first fluid tube 61 is a fluid tube configured to connect the brake mechanism 30 and the brake switching valve 80*a* to each other. And, as in the first embodiment, the first fluid tube 61 includes a first brake fluid tube 61*a* and a second brake fluid tube 61*b*. Meanwhile, in FIG. 4, only the first brake fluid tube 61*a* is shown for convenience of the explanation.

The second fluid tube 62 is a fluid tube configured to connect the HST pump 52 and the anti-stalling proportional valve 82 to each other. In this embodiment, the second fluid tube 62 includes a section 40*a* of the outputting fluid tube 40 and a traveling fluid tube 45. Meanwhile, in FIG. 4, a part of the traveling fluid tube 45 is shown for convenience of the explanation. One end of the third fluid tube 63 is connected to an intermediate portion of the first brake fluid tube 61*a*, and the other end of the third fluid tube is connected to an intermediate portion of the section 40*a* of the outputting fluid tube 40.

As described above, similarly to the relation between the switching of the brake switching valve 80*a* and the opening aperture (the pressure) of the speed-changing proportional valve 81*b* as described in the first embodiment, the relation between the switching of the brake switching valve 80*a* and the opening aperture (the pressure) of the anti-stalling proportional valve 82 is set. In this manner, the hydraulic fluid in the first fluid tube 61 or the second fluid tube 62 is allowed to be supplied to the output port of the brake switching valve 80*a* and to the output port of the anti-stalling proportional valve 82, and thereby the warming-up is carried out easily.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

In the above-described embodiments, the first measuring device to the fourth measuring device are employed, and the warming-up is carried out based on the measured values measured by the respective measuring devices. However, in place of that configuration, the control device 90 may store the opening apertures of the first operation valve and the second operation valve, the opening apertures being employed in the warming-up, and thereby may carry out the worming-up without the measurements by the first measuring device to the fourth measuring device.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system for a working machine, comprising:

a hydraulic pump to output an operation fluid;

a first hydraulic apparatus to be activated by the operation fluid;

a second hydraulic apparatus other than the first hydraulic apparatus, the second hydraulic apparatus being configured to be activated by the operation fluid;

a first operation valve to control the operation fluid to be supplied to the first hydraulic apparatus;

a second operation valve to control the operation fluid to be supplied to the second hydraulic apparatus;

a first fluid tube connecting the first operation valve to the first hydraulic apparatus;

a second fluid tube connecting the first operation valve to the second hydraulic apparatus;

a third fluid tube connecting the first fluid tube to the second fluid tube; and an outputting fluid tube connected to any one of the first operation valve and the second operation valve and configured to output the operation fluid supplied from any one of the first fluid tube and the second fluid tube.

2. The hydraulic system for the working machine according to claim 1, comprising:

a control device to operate the first operation valve and the second operation valve to output the operation fluid in the first fluid tube and the second fluid tube to the outputting fluid tube.

3. The hydraulic system for the working machine according to claim 1, wherein the first hydraulic apparatus is a brake mechanism configured to brake the traveling device and release the braking based on a pressure of the operation fluid supplied from the first fluid tube, and wherein the second hydraulic apparatus is a speed-changing mechanism configured to change a speed of the traveling device based on a pressure of the operation fluid supplied from the second fluid tube.

4. The hydraulic system for the working machine according to claim 3, wherein the first operation valve is a brake switching valve configured to be switched between a first position and a second position, the first position allowing a pressure of the operation fluid supplied to the brake mechanism to be set to a pressure braking the brake mechanism, the second position allowing the pressure of the operation fluid supplied to the brake mechanism to be set to a pressure releasing the braking, and wherein the second operation valve is a speed-changing switching valve configured to be switched between a third position and a fourth position, the third position allowing a pressure of the operation fluid supplied to the speed-changing mechanism to be a pressure activating the speed-changing mechanism at a predetermined speed, the second position allowing the pressure of the operation fluid supplied to the speed-changing mechanism to be a pressure activating the speed-changing mechanism at a speed higher than the predetermined speed.

5. The hydraulic system for the working machine according to claim 3, wherein the first operation valve is a brake switching valve configured to be switched between a first position and a second position, the first position allowing a pressure of the operation fluid supplied to the brake mechanism to be set to a pressure braking the brake mechanism, the second position allowing the pressure of the operation fluid supplied to the brake mechanism to be set to a pressure releasing the braking, and wherein the second operation valve is a speed-changing proportional valve configured to set a pressure of the operation fluid supplied to the speed-changing mechanism to be a pressure capable of changing a speed of the speed-changing mechanism.

6. The hydraulic system for the working machine according to claim 3, wherein the first operation valve is a brake proportional valve configured to set a pressure of the operation fluid applied to the brake mechanism to be a pressure braking the brake mechanism and releasing the braking, and wherein the second operation valve is a speed-changing proportional valve configured to set a pressure of the operation fluid supplied to the speed-changing mechanism to be a pressure capable of changing a speed of the speed-changing mechanism.

7. The hydraulic system for the working machine according to claim 1, wherein the first hydraulic apparatus is a brake mechanism configured to brake the traveling device and release the braking based on a pressure of the operation fluid supplied from the first fluid tube, and wherein the first operation valve is a brake switching valve configured to be switched between a first position and a second position, the first position allowing a pressure of the operation fluid supplied to the brake mechanism to be set to a pressure braking the brake mechanism, the second position allowing the pressure of the operation fluid supplied to the brake mechanism to be set to a pressure releasing the braking, and wherein the second hydraulic apparatus is a traveling pump configured to be driven by an engine and to change a driving force to drive the traveling device based on a pressure of the operation fluid supplied from the second fluid tube, and wherein the second valve is an anti-stalling proportional valve configured to change, based on a revolution speed of the engine, the pressure of the operation fluid supplied to the second fluid tube and thereby to perform an anti-stalling operation.

8. The hydraulic system for the working machine according to claim 1, comprising a throttling portion disposed on the third fluid tube.

9. The hydraulic system for the working machine according to claim 1, comprising:

a first bypass fluid tube connected to the third fluid tube; and a first check valve disposed on the first bypass fluid tube, the first check valve being configured to supply the operation fluid from the second fluid tube to the first fluid tube and to block the operation fluid flowing from the first fluid tube toward the second fluid tube.

10. The hydraulic system for the working machine according to claim 1, comprising:

a second bypass fluid tube connected to the first fluid tube between the first operation valve and the third fluid tube; and a second check valve disposed on the second bypass fluid tube, the second check valve being configured to supply the operation fluid from a connecting portion between the first fluid tube and the third fluid tube toward the first operation valve and to block the operation fluid flowing from the first operation valve side to the connecting portion between the first fluid tube and the third fluid tube.

11. The hydraulic system for the working machine according to claim 1, wherein the outputting fluid tube is connected to an outputting port of the first operation valve or the second operation valve.

* * * * *